US011898409B2

(12) United States Patent
Bivens et al.

(10) Patent No.: US 11,898,409 B2
(45) Date of Patent: Feb. 13, 2024

(54) DOWNHOLE COMPONENT DEPLOYMENT METHOD AND APPARATUS

(71) Applicant: Halliburton Energy Services, Inc., Houston, TX (US)

(72) Inventors: Eric Bivens, Denver, CO (US); Philippe Quero, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 3 days.

(21) Appl. No.: 17/490,949

(22) Filed: Sep. 30, 2021

(65) Prior Publication Data

US 2023/0100469 A1 Mar. 30, 2023

(51) Int. Cl.
*E21B 23/01* (2006.01)
*E21B 23/00* (2006.01)

(52) U.S. Cl.
CPC ..... *E21B 23/006* (2013.01); *E21B 23/01* (2013.01)

(58) Field of Classification Search
CPC ..... E21B 23/01; E21B 23/03; E21B 23/06; E21B 23/10; E21B 23/006
See application file for complete search history.

(56) References Cited

U.S. PATENT DOCUMENTS

2005/0034875 A1 2/2005 McLoughlin et al.
2010/0282478 A1* 11/2010 Giem ..... E21B 33/05 166/70
2011/0108284 A1 5/2011 Flores et al.
2012/0018147 A1* 1/2012 Niconoff ..... E21B 49/10 166/250.01
2012/0090835 A1 4/2012 Kefi
2016/0348467 A1 12/2016 Watson et al.
2020/0392802 A1 12/2020 Quero et al.
2021/0115754 A1* 4/2021 Triche ..... E21B 33/12
2023/0332476 A1 10/2023 Morrison et al.

FOREIGN PATENT DOCUMENTS

EP 2196619 A1 * 6/2010 ..... E21B 23/00
GB 2592670 A * 9/2021 ..... E21B 23/00
WO 03-064810 8/2003

OTHER PUBLICATIONS

International Search Report and Written Opinion for Application No. PCT/US2021/054603, dated Jun. 27, 2022.

* cited by examiner

*Primary Examiner* — D. Andrews
*Assistant Examiner* — Ronald R Runyan
(74) *Attorney, Agent, or Firm* — Thomas Rooney; C. Tumey Law Group PLLC

(57) ABSTRACT

A system for deploying downhole components includes a housing apparatus comprising a tool chamber configured to house a plurality of downhole tools and a conveyance configured to run the housing apparatus along the wellbore. The housing apparatus is secured to an end of the conveyance. The system for deploying downhole components also includes an actuation mechanism configured to selectively eject individual downhole tools of the plurality of downhole tools from the housing apparatus at respective locations in the wellbore.

18 Claims, 5 Drawing Sheets

DOWNHOLE COMPONENT DEPLOYMENT METHOD AND APPARATUS

BACKGROUND

During well completion operations, various downhole tools (e.g., plugs, choke orifices, flow rate monitoring tools, etc.) are lowered into the wellbore (e.g., run in hole) and installed at various locations along the wellbore. Generally, a downhole tool is secured to an end of a conveyance (e.g., wireline, coiled tubing, piping, etc.) and lowered into the wellbore to a desired location. At the desired location, the downhole tool disengages from the conveyance for installation. After the downhole tool is disengaged, the conveyance is raised to the surface (e.g., pulled out of hole) to secure another downhole tool. The process is repeated until each required downhole tool is installed within the wellbore. However, pulling the conveyance out of hole between installation of each downhole tool is time consuming and costly.

BRIEF DESCRIPTION OF THE DRAWINGS

These drawings illustrate certain aspects of some of the embodiments of the present disclosure and should not be used to limit or define the method.

DETAILED DESCRIPTION

Disclosed herein are systems and methods for conveying and installing multiple downhole tools in a single run. In particular, disclosed herein is a downhole deployment apparatus that houses multiple downhole tools. The downhole deployment apparatus selectively ejects respective downhole tools at desired locations along the wellbore. The downhole tools may self-anchor to the wellbore walls after disengaging from the downhole deployment apparatus.

Figure 1:
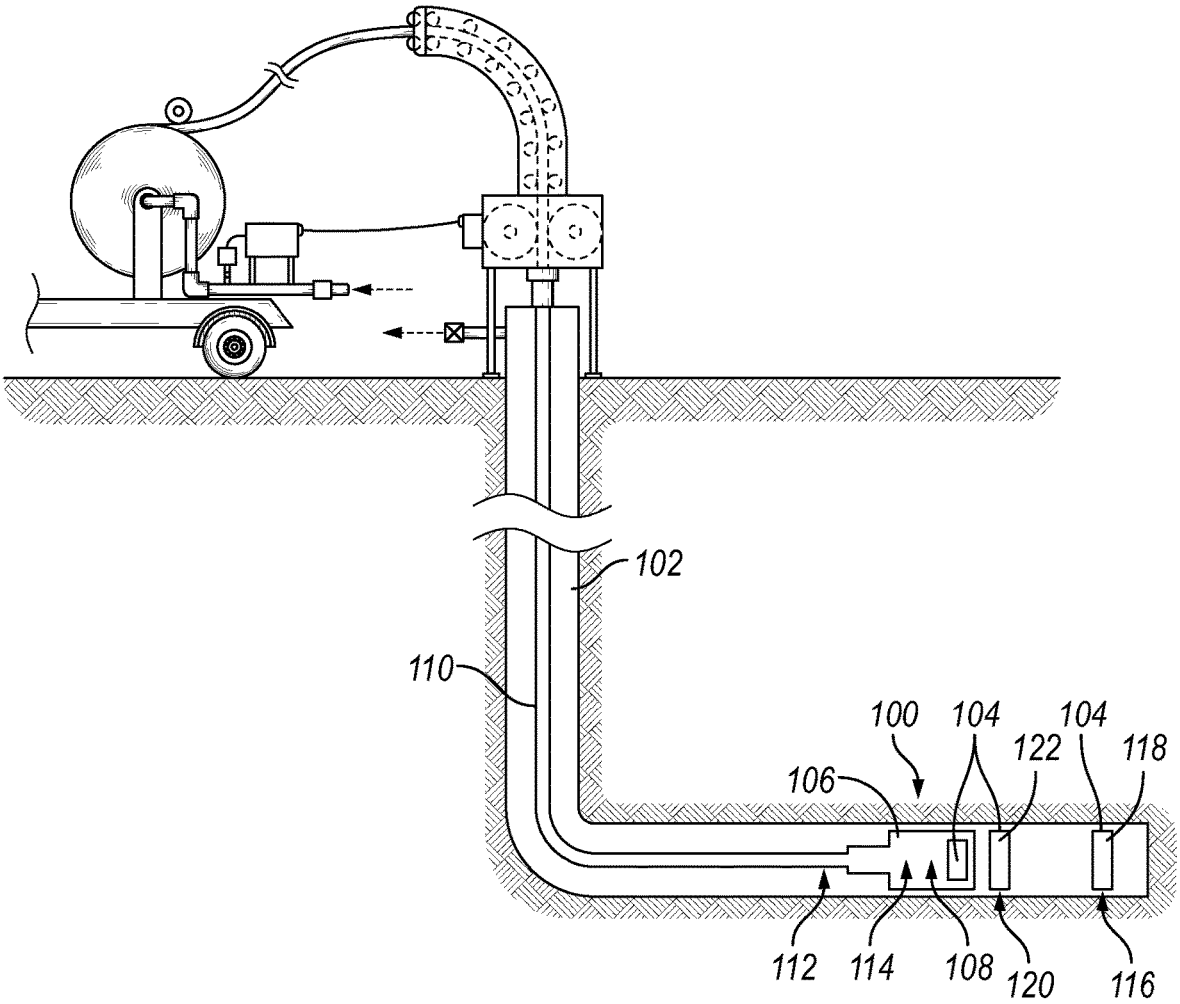
FIG. 1 illustrates a cross-sectional view of a downhole tool deployment apparatus disposed in a wellbore, in accordance with some embodiments of the present disclosure.

FIG. 1 illustrates a downhole tool deployment apparatus 100 disposed in a wellbore 102 and configured to deploy multiple downhole tools 104 in a single run. The downhole tool deployment apparatus 100 includes a housing apparatus 106 having a tool chamber 108 for housing the multiple downhole tools 104. Indeed, the tool chamber 108 may be configured to house various types of downhole tools 104 such as plugs to create isolation points or barriers in the wellbore 102, choke orifices to create flow increase points for improved production, flow rate monitoring tools, downhole gauges and sensors, and/or other suitable downhole tools 104. After loading the downhole tools 104 into the housing apparatus 106, the housing apparatus 106 may be run-in-hole via a conveyance 110 (e.g., coiled tubing, segmented drill piping, wireline, etc.). Further, the housing apparatus 106 may be secured to a lower end 112 of the conveyance 110 such that the housing apparatus 106 is disposed downhole the conveyance 110 during installation operations.

Installation operations may include the downhole tool deployment apparatus 100 selectively ejecting each downhole tool of the multiple downhole tools 104 from the housing apparatus 106 at a respective location along the wellbore 102 via an actuation mechanism 114. For example, the housing apparatus 106 may be run-in-hole to a first location 116 corresponding to a first downhole tool 118 and eject the first downhole tool 118 using the actuation mechanism 114. After ejecting the first downhole tool 118, the housing apparatus 106 may move uphole to a second location 120 corresponding to a second downhole tool 122 and eject the second downhole tool 122 using the actuation mechanism 114. The downhole tool deployment apparatus 100 may continue to eject downhole tools 104 with the actuation mechanism 114 at desired locations as the housing apparatus 106 moves along the wellbore 102. In some embodiments, the downhole tools 104 may be self-anchoring or self-sealing once ejected from the housing apparatus 106. The self-anchoring downhole tools 104 may include expandable slips, resistance pads on a spring arm, leaf springs, etc. Further, the self-sealing downhole tools 104 may include expandable cups or swellable elastomers.

Figure 2:
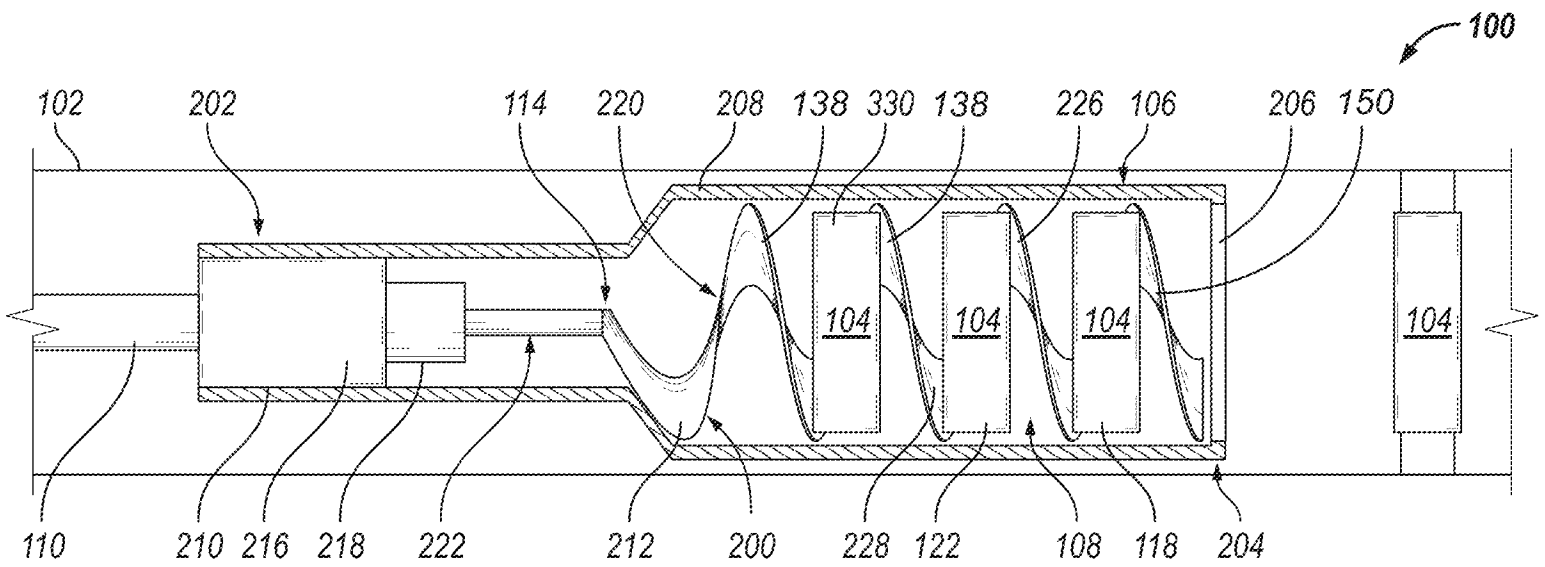
FIG. 2 illustrates a cross-sectional view of a downhole tool deployment apparatus comprising an actuation mechanism having a continuous screw, in accordance with some embodiments of the present disclosure.

FIG. 2 illustrates a cross-sectional view of a downhole tool deployment apparatus 100 comprising the actuation mechanism 114 having a continuous screw 200, in accordance with some embodiments of the present disclosure. As set forth above, the downhole tool deployment apparatus 100 includes a housing apparatus 106 for housing the multiple downhole tools 104 of the same or various types. An upper axial end 202 of the housing apparatus 106 is configured to couple to a conveyance 110 for running the housing apparatus 106 along the wellbore 102. A lower axial end 204 of the housing apparatus 106, opposite the upper axial end 202, has a lower opening 206 for loading and deploying the multiple downhole tools 104. That is, the downhole tools 104 may be configured to pass through the lower opening 206 during loading operations and deployment into the wellbore 102. Moreover, the lower opening 206 extends through an outer housing 208 of the housing apparatus 106 to the tool chamber 108. As illustrated, the tool chamber 108, which is configured to house the multiple downhole tools 104 of the same or various types, is disposed within the outer housing 208 of the housing apparatus 106. In some embodiments, the tool chamber 108 may extend from the upper axial end 202 of the housing apparatus 106 to the lower axial end 204. In the illustrated embodiment, the tool chamber 108 extends through only a portion of the housing apparatus 106. That is, the tool chamber 108 extends from the lower axial end 204 to a motor 216 housing 210 disposed within the outer housing 208.

As set forth above, the downhole tool deployment apparatus 100 further includes the actuation mechanism 114. In the illustrated embodiment, the actuation mechanism 114 includes a continuous screw 200 mechanism having a rotating helical screw blade 212. In the illustrated embodiment, the rotating helical screw blade 212 is shaftless (e.g., spiral). However, in some embodiments, the rotating helical screw blade 212 may be shafted (e.g., screw). Further, the rotating helical screw blade 212 may be single flight, double flight, tapered single flight, tapered double flight, or any suitable flight. The rotating helical screw blade 212 may also have standard pitch or variable pitch. Generally, the rotating helical screw blade 212 may be shaped such that individual downhole tools 104 may fit between fighting 138 (e.g., blades) of the helical screw blade 212.

Moreover, the actuation mechanism 114 (e.g., continuous screw 200 mechanism) may further include a motor 216 to drive rotation of the rotating helical screw blade 212. The motor 216 may be electrically or hydraulically powered. In the illustrated embodiment, the motor 216 is an electric drive motor 216 configured to rotate the helical screw blade 212 in response to electric communication from a control system disposed at a surface. Indeed, the electric drive motor 216 may be powered and/or controlled by the electric communication from the control system. Further, the actuation mechanism 114 may be electrically coupled to the control system via a wired connection (e.g., electric and/or fiber-optic cables) such that the control system may transmit power and or instructions to the electric drive motor 216.

At least a portion of the electric drive motor 216 may be positioned within the motor 216 housing 210, which is disposed in the outer housing 208 of the housing apparatus 106. In the illustrated embodiment, the motor 216 housing 210 is positioned proximate the upper axial end 202 of the housing apparatus 106. The electric drive motor 216 may include a drive shaft 218 extending from the electric drive motor 216 in a direction toward the lower axial end 204 of the housing apparatus 106. An attachment end 222 of the rotating helical screw blade 212 may be secured to the drive shaft 218 such that rotation of the drive shaft 218 drives rotation of the rotating helical screw blade 212. A blade portion 220 of the rotating helical screw blade 212 extends from the attachment end 222 in a direction toward the lower axial end 204 of the housing apparatus 106. As illustrated, the blade portion 220 is positioned at least partially within the tool chamber 108. The blade portion 220 of the rotating helical screw blade 212 may be shaped such that individual downhole tools 104 may fit in gaps defined between the flighting 138 (e.g., blades).

Prior to entry of the downhole tool deployment apparatus 100 into the wellbore 102, a plurality of downhole tools 104 may be loaded into the housing apparatus 106 via the continuous screw 200 mechanism. For example, the second downhole tool 122 may be inserted into the housing apparatus 106 through the lower opening 206 and positioned proximate a first fighting 150 of the rotating helical screw blade 212. The rotating helical screw blade 212 may then be rotated in reverse; thereby, carrying the second downhole tool 122 in a direction toward the upper axial end 202 of the housing apparatus 106 and to a position between the first fighting 150 and a second fighting 226. The first downhole tool 118 may then be inserted into the housing apparatus 106 through the lower opening 206 and positioned proximate the first fighting 150. The rotating helical screw blade 212 may again be rotated in reverse; thereby, further carrying the second downhole tool 122 toward the upper axial end 202 and to a position between the second fighting 226 and a third fighting 228, as well as carrying the first downhole tool 118 to a position between the first fighting 150 and the second fighting 226. Additional downhole tools 104 may be loaded into the housing apparatus 106 in a similar manner.

After entry of the downhole tool deployment apparatus 100 into the wellbore 102, the rotating helical screw blade 212 may be rotated forward to deploy each of the downhole tools 104 at a desired location along the wellbore 102. In particular, once the control system determines that the downhole tool deployment apparatus 100 is positioned at a desired location, the control system may output a signal to cause the electric drive motor 216 to rotate the rotating helical screw blade 212 by a determined angular degree (e.g., 360°) such that a downhole tool 104 (e.g., the first downhole tool 118) most proximate the lower opening 206 is carried past the first flighting 150 of the rotating helical screw blade 212 and through the lower opening 206. Once the downhole tool 104 is ejected, the conveyance 110 may move the downhole tool deployment apparatus 100 to another desired location along the wellbore 102. Again, the control system may output a signal causing the rotating helical screw blade 212 to rotate and carry another downhole tool 104 (e.g., the second downhole tool 122) past the first fighting 150 of the rotating helical screw blade 212 and through the lower opening 206. Additional downhole tools 104 may be ejected at desired locations along the wellbore 102 in a similar manner.

Figure 3A:
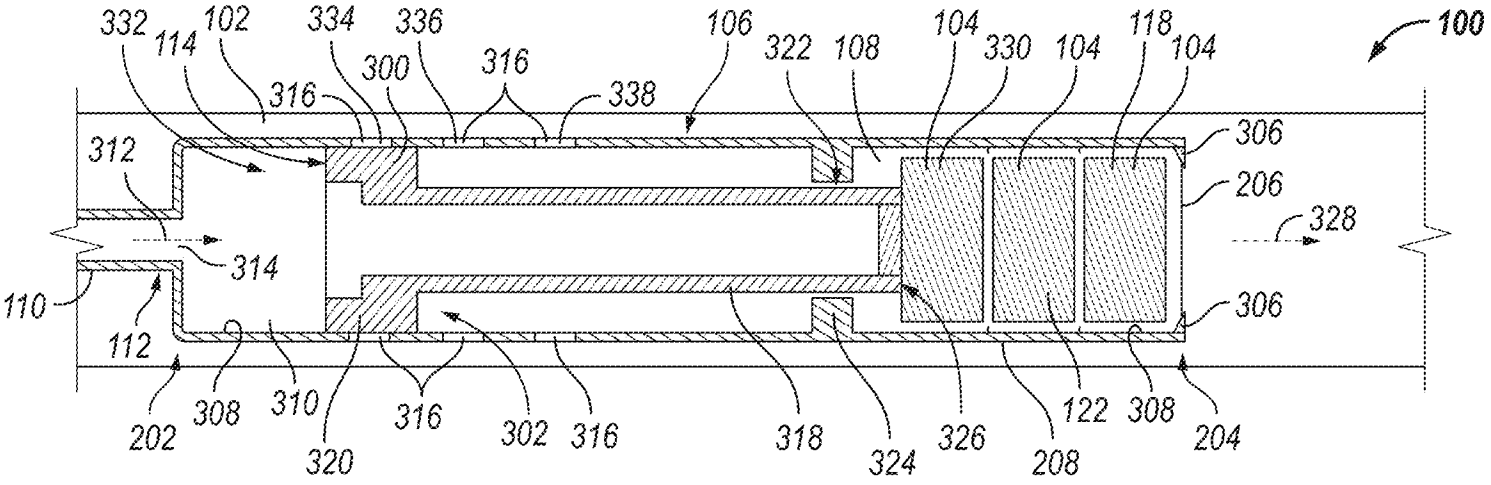
FIGS. 3A and 3B illustrate cross-sectional views of a downhole tool deployment apparatus comprising an actuation mechanism having an inner housing in a first position and a second position, respectively, in accordance with some embodiments of the present disclosure.
Figure 3B:
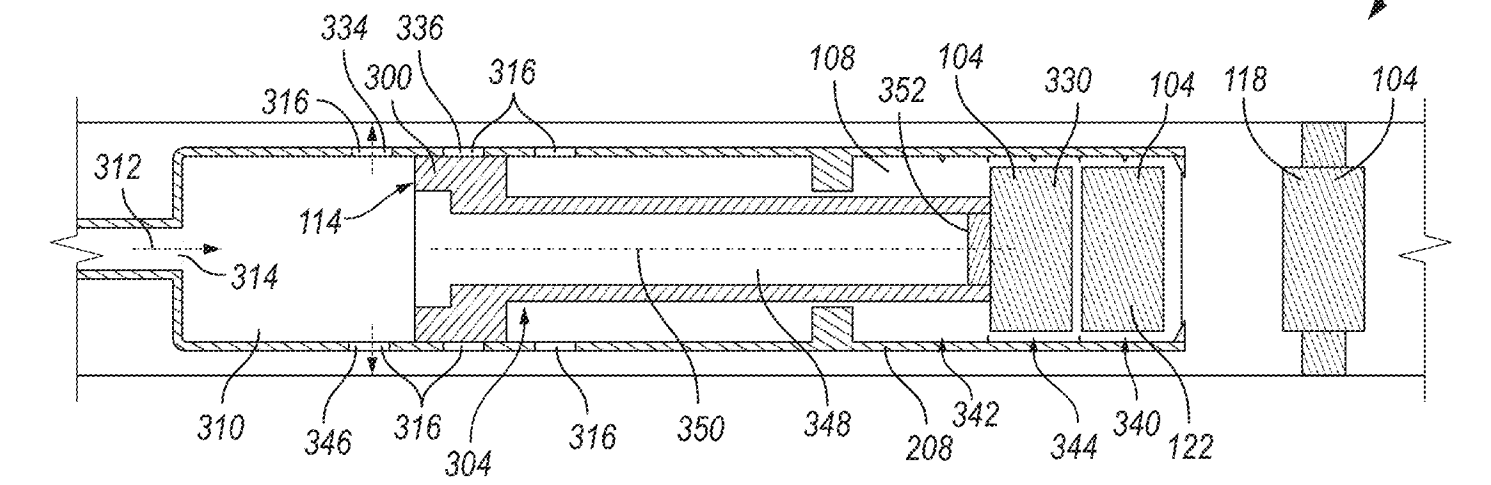

FIG. 3A-3B illustrate cross-sectional views of a downhole tool deployment apparatus 100 comprising an actuation mechanism 114 having an inner housing 300 in a first position 302 and a second position 304, respectively, in accordance with some embodiments of the present disclosure.

FIG. 3A discloses the downhole tool deployment apparatus 100 with the actuation mechanism 114 having the inner housing 300 in a first position 302. As set forth above, the downhole tool deployment apparatus 100 includes the housing apparatus 106 for housing the multiple downhole tools 104 of the same or various types. Specifically, the housing apparatus 106 includes the tool chamber 108 for housing the downhole tools 104. The tool chamber 108 is disposed within the outer housing 208 of the housing apparatus 106. The lower axial end 204 of the housing apparatus 106, opposite the upper axial end 202, has the lower opening 206 for loading and deploying the multiple downhole tools 104. That is, the downhole tools 104 may be configured to pass through the lower opening 206 during loading operations and deployment into the wellbore 102. The housing apparatus 106 may further include at least one retention device 306 (e.g., shear pins, a collet, retention fingers, etc.) positioned within the tool chamber 108 and/or the lower opening 206. The retention device 306 is configured to at least partially restrain at least one downhole tool of the plurality of downhole tools 104 from sliding axially toward and/or through the lower opening 206 in the lower axial end 204. For example, the retention device 306 may include shear pins configured to secure each of the downhole tools 104 to an inner surface 308 of the outer housing 208 at respective positions within the tool chamber 108 to restrain the downhole tools 104 from sliding axially toward the lower opening 206. In another example, the retention device 306 may include retention fingers positioned proximate the lower opening 206 to restrain the downhole tools 104 from sliding axially through the lower opening 206. Specifically, the retention fingers may be spring loaded, via at least one spring, such that the retention fingers may be biased toward a blocking position (e.g., a position to at least partially obstruct a path through the lower opening 206.) As such, the retention fingers may contact the downhole tool 104 as the downhole tool 104 slides toward the lower opening 206. Such contact may restrain axial movement of the downhole tool 104 from continuing through the lower opening 206. The at least one spring may provide sufficient spring force to hold the retention fingers in the blocked position. However, the retention fingers may be configured to rotate and/or retract out of the path through the lower opening 206 in response to the downhole tool 104 being driven with sufficient force to overcome the spring force biasing the retention fingers toward the blocking position. Once the downhole tool moves past the retention fingers, the spring force may rotate and/or extend the retention fingers back to the blocking position such that retention fingers may restrain movement of any subsequent downhole tool 104 sliding axially toward the at least one opening 206.

Moreover, in the illustrated embodiment, the housing apparatus 106 includes a fluid chamber 310 disposed within the outer housing 208 and configured to receive a fluid flow 312 from an upper opening 314 in the upper axial end 202 of the housing apparatus 106. Indeed, the fluid chamber 310 may be disposed proximate the upper axial end 202 of the housing apparatus 106. As set forth above, the upper axial end 202 of the housing apparatus 106 may be secured to a lower end 112 of the conveyance 110. Thus, the fluid chamber 310 may receive the fluid flow 312 from the conveyance 110 via the upper opening 314. As the fluid flow 312 passes into the fluid chamber 310, pressure in the fluid chamber 310 may increase. However, the outer housing 208 includes a plurality of fluid exhaust ports 316 extending from the fluid chamber 310 to the wellbore 102, and fluid may be exhausted from the fluid chamber 310 via the fluid exhaust ports 316 to reduce the pressure in the fluid chamber 310.

The housing apparatus 106 further includes the actuation mechanism 114 for selectively ejecting downhole tools 104 at respective locations along the wellbore 102. In the illustrated embodiment, the actuation mechanism 114 comprises an inner housing 300 with a substantially cylindrical shape disposed within the outer housing 208 of the housing apparatus 106. In some embodiments, the inner housing 300 has a cylindrical shape with a variable and/or stepped diameter. For example, in the illustrated embodiment, the inner housing 300 includes a piston portion 318 having a first diameter and a sealing portion 320 having a second diameter. The piston portion 318, which may have a smaller diameter than the sealing portion 320, may be disposed at least partially in a central passageway 322 extending from the fluid chamber 310 to the tool chamber 108 through a divider wall 324 between the fluid chamber 310 and the tool chamber 108. The sealing portion 320 of the inner housing 300 may be disposed within the fluid chamber 310 and configured to form a seal between the sealing portion 320 of the inner housing 300 and the radially inner surface 308 of the outer housing 208 in the fluid chamber 310.

Moreover, in response to the fluid pressure in the fluid chamber 310 acting on the inner housing 300, the inner housing 300 is configured to slide axially toward the lower axial end 204 of the outer housing 208. That is, the sealing portion 320 is configured to slide axially along the radially inner surface 308 in the fluid chamber 310 and the piston portion 318 is configured to slide axially along the central passageway 322. Indeed, the piston portion 318 of the inner housing 300 may be driven toward the lower axial end 204 of the housing apparatus 106. Contact between an axial face 326 of the piston portion 318 and a downhole tool of the plurality of downhole tools 104 may drive at least one of the plurality of downhole tools 104 in an axially downward direction 328 toward the lower opening 206 and/or out the lower opening 206 as the inner housing 300 slides axially toward the lower axial end 204. For example, to selectively eject a first downhole tool 118, fluid pressure from the fluid flow 312 into the housing apparatus 106 may drive the inner housing 300 into a third downhole tool 330, positioned uphole from the first downhole tool 118 and the second downhole tool 122. Driving the inner housing 300 into the third downhole tool 330 may slide the first, second, and third downhole tools 118, 122, 330 axially toward the lower opening 206 and eject the first downhole tool 118. Selectively ejecting the second downhole tool 122 includes further driving the inner housing 300 into the third downhole tool 330 to slide the second and third downhole tools 122, 330 axially and eject the second downhole tool 122.

The pressure in the fluid chamber 310 to slide the inner housing 300 may be based at least in part on an outgoing volumetric flow rate of the fluid exhausted through the plurality of fluid exhaust ports 316 and the incoming volumetric flow rate of the fluid flow 312 via the upper opening 314. That is, if the incoming volumetric flow rate is greater than the outgoing volumetric flow rate then the pressure in the fluid chamber 310 increases. When the pressure on an upper side 332 of the inner housing 300 is sufficient to overcome forces opposing axial movement of the inner housing 300, the inner housing 300 will slide axially along the outer housing 208 toward the lower axial end 204 of the outer housing 208. In some embodiments, the inner housing 300 is configured to cease sliding after ejecting the first downhole tool 118 and before ejecting the second downhole tool 122 while under a constant incoming volumetric flow rate into the fluid chamber 310. That is, the housing apparatus 106 may be configured to experience a pressure drop sufficient to cease movement of the inner housing 300 after ejecting each of the downhole tools 104 of the plurality of downhole tools 104.

The positioning of the fluid exhaust ports 316 may be configured to generate the pressure drops. In particular, the plurality of fluid exhaust ports 316 may be axially offset along the outer housing 208 to generate the pressure drops. In the illustrated embodiment, the inner housing 300 is in the first position 302 with the lower axial face 326 of the piston portion 318 in contact with a third downhole tool 330 and the sealing portion 320 blocking fluid in the fluid chamber 310 from flowing through a first fluid exhaust port 334, a second fluid exhaust port 336 axially offset from the first fluid exhaust port 334 in the axially downward direction 328, and a third fluid exhaust port 338 axially offset from the second fluid exhaust port 336 in the axially downward direction 328. With the first 334, second 336, and third fluid exhaust ports 338 blocked, the incoming fluid flow 312, at a first volumetric flow rate, is configured to increase the pressure in the fluid chamber 310 and drive the inner housing 300 toward the lower axial end 204 of the outer housing 208.

FIG. 3B discloses the downhole tool deployment apparatus 100 with the actuation mechanism 114 having the inner housing 300 in a second position 304. In response to the pressure in the fluid chamber 310 on the inner housing 300 in the first position 302 (shown in FIG. 3A), the inner housing 300 is configured to slide to the second position 304; thereby, driving the plurality of downhole tools 104 to eject the first downhole tool 118, move the second downhole tool 122 to a first downhole tool slot 340, and move the third downhole tool 330 from a third downhole tool slot 342 to a second downhole tool slot 344. As set forth above, the inner housing 300 is configured to stop at the second position 304 instead of sliding past the second position 304 based at least in part on the pressure drop caused by moving the inner housing 300 to the second position 304 within the outer housing 208. Indeed, moving the inner housing 300 from the first position 302 (shown in FIG. 3A) to the second position 304 is configured to expose the first fluid exhaust port 334. That is, in the second position 304, the sealing portion 320 of the inner housing 300 is positioned axially downward from the first fluid exhaust port 334 such that fluid from the fluid chamber 310 may be exhausted through the first fluid exhaust port 334. Exhausting fluid through the fluid exhaust ports may maintain fluid circulation while running the downhole tools 104 into the wellbore 102 (e.g., pump-through capability.) As such, in some embodiments, the outer housing 208 may include an additional exhaust port (not shown) that may be permanently exposed (e.g., exposed in all positions of the inner housing 300.)

As set forth above, the amount of pressure in the fluid chamber 310 may be based at least in part on the outgoing volumetric flow rate of the fluid exhausted through the plurality of fluid exhaust ports 316 and the incoming volumetric flow rate of the fluid flow 312 via the upper opening 314. In the second position 304, the incoming fluid flow 312 at the first volumetric flow rate from the conveyance 110 may be less than the outgoing volumetric flow rate through at least the first fluid exhaust port 334 such that the pressure in the fluid chamber 310 decreases below a pressure required to slide the inner housing 300. Accordingly, the pressure drop caused by the first fluid exhaust port 334 is configured to stop the inner housing 300 at the second position 304. Moreover, in some embodiments, the actuation mechanism may include at least one additional fluid exhaust port 346 that is axially aligned with the first fluid exhaust port 334 to increase the outgoing volumetric flow rate in the second position 304 and generate a greater pressure drop for stopping the inner housing 300. Further, the size and/or shape of the first fluid exhaust port 334 and/or the at least one additional fluid exhaust port 346 may be configured based on a required outgoing volumetric flow rate. For example, a diameter of the first fluid exhaust port 334 and/or the at least one additional fluid exhaust port 346 may be increased to increase the outgoing volumetric flow rate.

The inner housing 300 may be configured to remain in the second position 304 with the incoming fluid flow 132 at the first volumetric flow rate in response to the pressure drop from the first fluid exhaust port 334. To move the inner housing 300 to a third position and eject the second downhole tool 122, the fluid flow 312 from the conveyance 110 may be increased to a second volumetric flow rate to overcome the pressure drop and increase pressure in the fluid chamber 310. The pressure in the fluid chamber 310 may be configured to move the inner housing 300 from the second position 304 to the third position. Moving the inner housing 300 the third position may expose the second fluid exhaust port 336 such that fluid from the fluid chamber 310 may be exhausted through the first fluid exhaust port 334 and the second fluid exhaust port 336. The outgoing volumetric flow rate from fluid flowing through at least the first fluid exhaust port 334 and the second fluid exhaust port 336 may exceed the incoming second volumetric flow rate such that the inner housing 300 may stop at the third position after ejecting the second downhole tool 122. In some embodiments, the actuation mechanism 114 may include at least one axially offset fluid exhaust port 136 corresponding to each downhole tool slot such that inner housing 300 may be selectively advanced along the outer housing 208 to selectively eject each of the downhole tools 104 from the outer housing 208 at respective locations along the wellbore 102.

Moreover, in some embodiments, the inner housing 300 may include a central bore 348 extending along a central axis 350 of the inner housing 300. In the illustrated embodiment, the central bore 348 extends through the inner housing 300 and a rupture disc 352 is disposed in the central bore 348 to seal the central bore 348 such that fluid may not pass through the central bore 348 and into the tool chamber 108 during installation operations. The rupture disc 352 may be configured to break to allow fluid to flow through the central bore 348 after each of the plurality of downhole tools 104 have been ejected from the tool chamber 108. The rupture disc 352 may be configured to break in response to a pressure in the fluid chamber 310 reaching a rupture disc threshold pressure. A volumetric flow rate required to increase the pressure to the rupture disc threshold pressure may be greater than any volumetric flow rate required to eject the plurality of downhole tools 104 such that the rupture disc 352 maintains the seal on the central bore 348 during installation operations.

Figure 4:
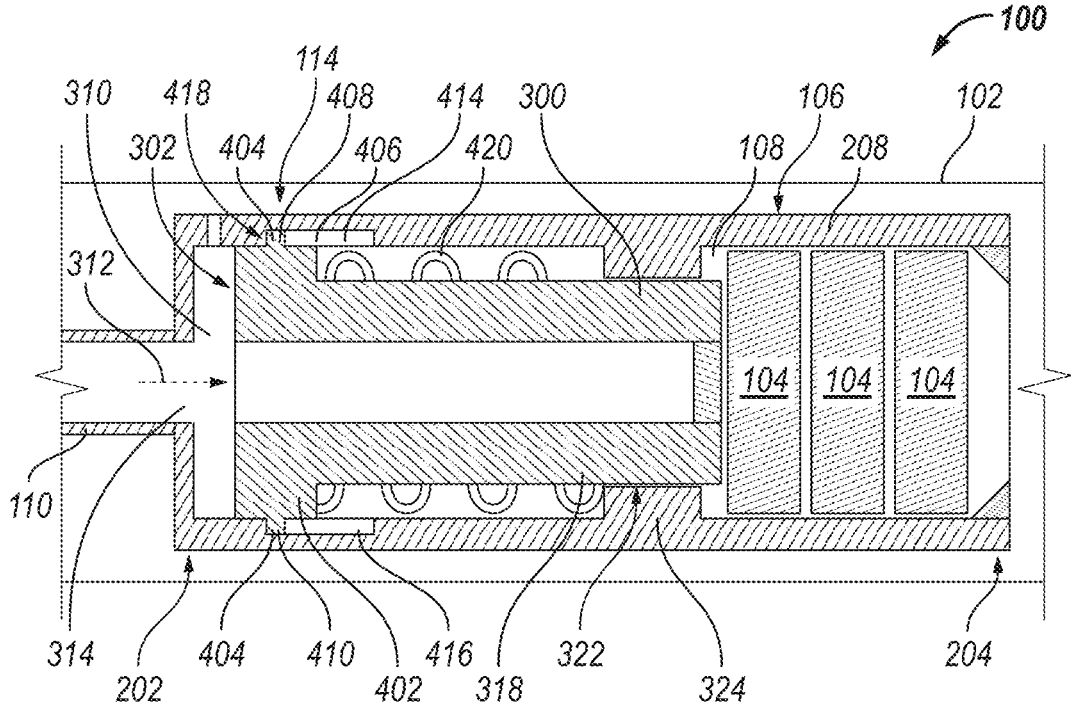
FIG. 4 illustrates a cross-sectional view of a downhole tool deployment apparatus comprising an actuation mechanism having an inner housing guided by a progressive J-slot mechanism, in accordance with some embodiments of the present disclosure.

FIG. 4 illustrates a cross-sectional view of a downhole tool deployment apparatus 100 comprising an actuation mechanism 114 having an inner housing 300 guided by a progressive J-slot mechanism 400, in accordance with some embodiments of the present disclosure. As set forth above, the downhole tool deployment apparatus 100 includes the housing apparatus 106 for housing the multiple downhole tools 104 of the same or various types. The housing apparatus 106 includes the tool chamber 108 for housing the downhole tools 104, as well as the fluid chamber 310 configured to receive fluid flow from the conveyance 110 via the upper opening 314 in the upper axial end 202 of the housing apparatus 106. The tool chamber 108 and the fluid chamber 310 may be defined by the outer housing 208. Moreover, the inner housing 300 is disposed within the outer housing 208 of the housing apparatus 106. Specifically, the inner housing 300 is disposed at least partially within the fluid chamber 310, the tool chamber 108, and/or the central passageway 322 extending from the fluid chamber 310 to the tool chamber 108 through the divider wall 324 between the fluid chamber 310 and the tool chamber 108. Further, the inner housing 300 is configured to incrementally slide axially toward the lower axial end 204 of the outer housing 208 to selectively eject each of the downhole tools 104 from the outer housing 208 of the housing apparatus 106 at respective locations along the wellbore 102.

In the illustrated embodiment, the inner housing 300 has a substantially cylindrical shape with a variable and/or stepped diameter. The inner housing 300 includes the piston portion 318 having a first diameter and a shoulder portion 402 having a second diameter. The second diameter may be greater than the first diameter such that the shoulder portion 402 interfaces with the divider wall 324 between the fluid chamber 310 and the tool chamber 108 to prevent ejection of the inner housing 300 from the outer housing 208 after ejecting all of the plurality of downhole tools 104. Further, the inner housing 300 may include at least one pin 404 configured to interface with at least one J-slot 406 of the progressive J-slot mechanism 400. In the illustrated embodiment, the inner housing 300 comprises a first pin 408 and a second pin 410. However, the inner housing 300 may include any suitable number of pins. For example, the inner housing 300 may include four pins each equally offset (e.g., offset by 90 degrees) from each other about the shoulder portion 402 of the inner housing 300. The at least one pin 404 may include a substantially cylindrical protrusion extending from a radially outer surface 412 of the shoulder portion 402 of the inner housing 300. However, the at least one pin 404 may include any suitable shape. Further, the at least one pin 404 may be formed as part of the inner housing 300 or may be a separate component secured to the inner housing 300.

The outer housing 208 may include the at least one J-slot 406 configured to receive the at least one pin 404. In the illustrated embodiment, the outer housing 208 includes a first J-slot 414 configured to receive the first pin 408 and a second J-slot 416 configured to receive the second pin 410. As set forth in greater detail below, the at least one J-slot 406 may include a plurality of rest recesses (shown in FIG. 5) configured to hold the inner housing 300 in respective positions (e.g., the first position 302, the second position 304, etc.) when the fluid pressure in the fluid chamber 310 is below a threshold pressure. For example, the at least one J-slot 406 may include a first rest recess 418 configured to hold the inner housing 300 in the first position 302 in response to the fluid pressure in the fluid chamber 310 being less than the fluid pressure required to drive the inner housing 300 toward the lower axial end 204 of the outer housing 208 (e.g., the threshold pressure). Moreover, the actuation mechanism 114 may include a biasing mechanism 420 (e.g., compression spring, hydraulic device, etc.) configured to bias the inner housing 300 in a direction toward the upper axial end 202 of the outer housing 208. For example, the biasing mechanism 420 may bias the shoulder portion 402 of the inner housing 300, thereby, driving the first pin 408 of the inner housing 300 into the first rest recess 418 of the plurality of rest recesses when the fluid pressure in the fluid chamber 310 is below the threshold pressure.

Figure 5:
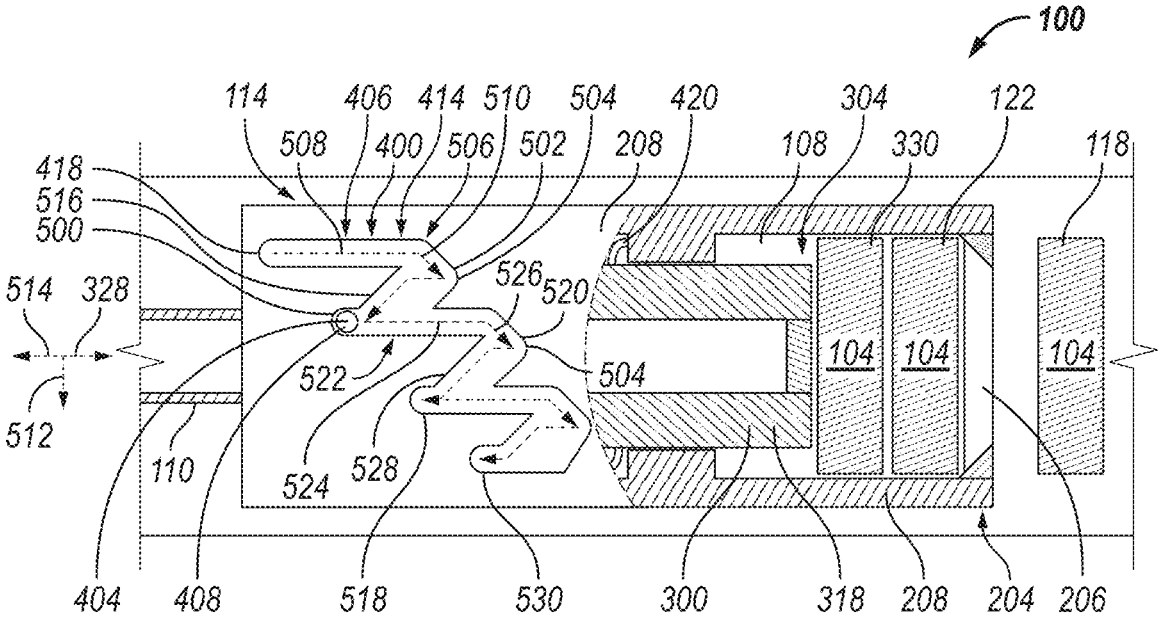
FIG. 5 illustrates a cutaway section view of a downhole tool deployment apparatus comprising an actuation mechanism having a J-slot mechanism, in accordance with some embodiments of the present disclosure.

FIG. 5 illustrates a cutaway section view of a downhole tool deployment apparatus 100 comprising an actuation mechanism 114 having a J-slot mechanism 400, in accordance with some embodiments of the present disclosure. The J-slot mechanism 400 is configured to incrementally slide the inner housing 300 axially toward the lower opening 206 in a lower axial end 204 of the outer housing 208 in response to intermittent fluid flow through the conveyance 110 to selectively eject each of the plurality of downhole tools 104.

To selectively eject the first downhole tool 118, the actuation mechanism 114 may be configured to move the inner housing 300 from the first position 302 (shown in FIG. 4) to the second position 304 such that the lower axial end 204 of the piston portion 318 of the inner housing 300 drives the plurality of downhole tools 104 toward the lower opening 206 in the outer housing 208 and ejects the first downhole tool 118. As the at least one pin 404 (e.g., the first pin 408) is rigidly attached to the inner housing 300, movement of the inner housing 300 may be fixed to movement of the at least one pin 404 along the at least one J-slot 406 (e.g., the first J-slot 414). As such, moving the inner housing 300 from the first position 302 to the second position 304 may include moving the at least one pin 404 from the first rest recess 418 to a second rest recess 500. To initiate movement from the first rest recess 418 to the second rest recess 500, the fluid flow 312 into the fluid chamber 310 (shown in FIG. 4) via the conveyance 110 may be increased; thereby, increasing the pressure in the fluid chamber 310 to a pressure above the threshold pressure such that the inner housing 300 is driven forward toward the lower axial end 204 of the outer housing 208. The inner housing 300 may continue to be driven forward until the first pin 408 contacts a first active recess 502 of a plurality of active recesses 504. The first active recess 502 is configured to block forward movement of the inner housing 300 while the pressure in the fluid chamber 310 is maintained above the threshold pressure. Further, the pressure driving the inner housing 300 may hold the at least one pin 404 at least partially within the first active recess 502.

The first active recess 502 may be azimuthally or circumferentially offset from the first rest recess 418. That is, a first downward leg 506 of the J-slot 406 leading from the first rest recess 418 to the first active recess 502 may at least partially extend about the curve or circumference of the outer housing 208. In the illustrated embodiment, the first downward leg 506 has a first axially aligned portion 508, as well as a first deviated portion 510 that extends in both the axially downward direction 328 and in a first azimuthal direction 512 about the curve of the outer housing 208. After the at least one pin 404 engages the first active recess 502 at an end of the first deviated portion 510, the fluid flow 312 into the fluid chamber 310 may be decreased such that the fluid pressure in the fluid chamber 310 falls below the threshold pressure. Fluid pressure in the fluid chamber 310 may be decreased via reducing a flow rate of the fluid flow 312 from the conveyance 110 such that an input flow rate falls below an exhaust flow rate of the fluid through the least one fluid exhaust port 316 in the outer housing 208. Fluid flow through the at least one fluid exhaust port 316 may maintain fluid circulation while running the downhole tools 104 into the wellbore 102 (e.g., pump-through capability.) In some embodiments, fluid may continuously flow through the at least one fluid exhaust port 316 during installation operations.

Moreover, in response to the fluid pressure falling below the threshold pressure, the biasing forces from the biasing mechanism 420 may drive the at least one pin 404 in an axially upward direction 514 into a first slanted guide wall 516. The first slanted guide wall 516 may direct the at least one pin 404 in both an axially upward direction 514 and the first azimuthal direction 512 about the curve of the outer housing 208. The second rest recess 500 may be disposed at an end of the first slanted guide wall 516 such that the first slanted guide wall 516 directs the at least one pin 404 into the second rest recess 500, which is disposed axially downward from the first rest recess 418. Further, the inner housing 300 may be positioned in the second position 304 with the at least one pin 404 disposed in the second rest recess 500.

To initiate movement from the second rest recess 500 to a third rest recess 518, a similar process may be repeated. Indeed, the fluid flow 312 into the fluid chamber 310 via the conveyance 110 may be increased; thereby, increasing the pressure in the fluid chamber 310 to a pressure above the threshold pressure such that the inner housing 300 is driven forward from the second rest recess 500 in the axially downward direction 328. The inner housing 300 may continue to be driven forward until the at least one pin 404 contacts a second active recess 520 of the plurality of active recesses 504. The second active recess 520 is also configured to block forward movement of the inner housing 300 while the pressure in the fluid chamber 310 is maintained above the threshold pressure. Further, the pressure driving the inner housing 300 may hold the at least one pin 404 at least partially within the second active recess 520.

The second active recess 520 may be azimuthally or circumferentially offset from the second rest recess 500. That is, a second downward leg 522 of the J-slot 406 leading from the second rest recess 500 to the second active recess 520 may at least partially extend about the curve or circumference of the outer housing 208. In the illustrated embodiment, the second downward leg 522 has a second axially aligned portion 524, as well as a second deviated portion 526 that extends in both the axially downward direction 328 and in the first azimuthal direction 512 about the curve of the outer housing 208. After the at least one pin 404 engages the second active recess 520 at an end of the second deviated portion 526, the fluid flow 312 into the fluid chamber 310 may be decreased such that the fluid pressure in the fluid chamber 310 falls below the threshold pressure. In response to the fluid pressure falling below the threshold pressure, the biasing forces from the biasing mechanism 420 may drive the at least one pin 404 in the axially upward direction 514 into a second slanted guide wall 528. The second slanted guide wall 528 may direct the at least one pin 404 in both an axially upward direction 514 and the first azimuthal direction 512 about the curve of the outer housing 208. The third rest recess 518 may be disposed at an end of the second slanted guide wall 528 such that the second slanted guide wall 528 directs the at least one pin 404 into the third rest recess 518, which is disposed axially downward from both the first rest recess 418 and the second rest recess 500. Further, the inner housing 300 may be positioned in the third position with the at least one pin 404 disposed in the third rest recess 518.

Moreover, the process may be similarly repeated to initiate movement from the third rest recess 518 to a fourth rest recess 530. In some embodiments, a number a rest recesses may correspond to a number of downhole tools 104 that may be housed within the tool chamber 108. For example, a tool chamber 108 configured to house three downhole tools 104 (e.g., the first downhole tool 118, the second downhole tool 122, and the third downhole tool 330) may include at least four rest recesses. Actuating the at least one pin 404 from the first rest recess 418 to the second rest recess 500 may eject the first downhole tool 118, actuating the at least one pin 404 from the second rest recess 500 to the third rest recess 518 may eject the second downhole tool 122, and actuating the at least one pin 404 from the third rest recess 518 to the fourth rest recess 530 may eject the third downhole tool 330. Accordingly, the J-slot mechanism 400 is configured to incrementally slide the inner housing 300 axially toward the opening in a lower axial end 204 of the outer housing 208 in response to intermittent fluid flow through the conveyance 110 to selectively eject each of the plurality of downhole tools 104.

Figure 6A:
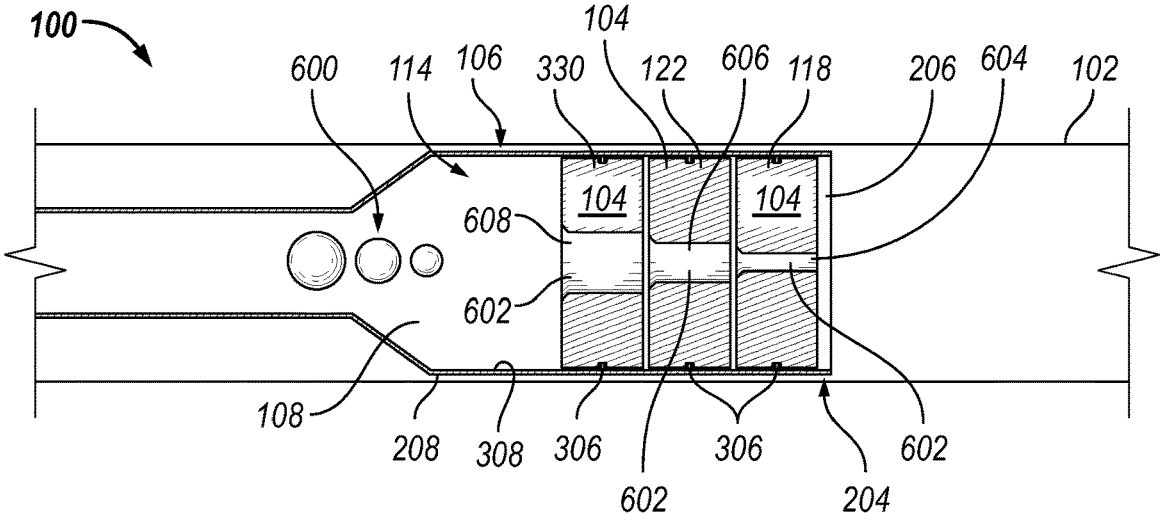
FIGS. 6A-6C illustrate cross-sectional views of a downhole tool deployment apparatus comprising an actuation mechanism having a plurality of variably sized balls corresponding to landing shoulders of respective downhole tools, in accordance with some embodiments of the present disclosure.
Figure 6B:
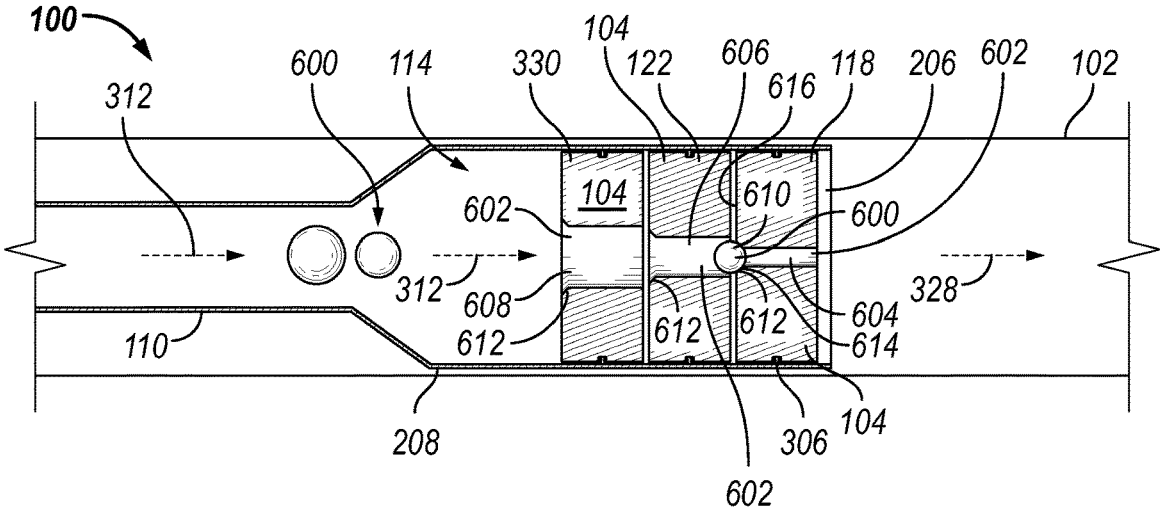
Figure 6C:
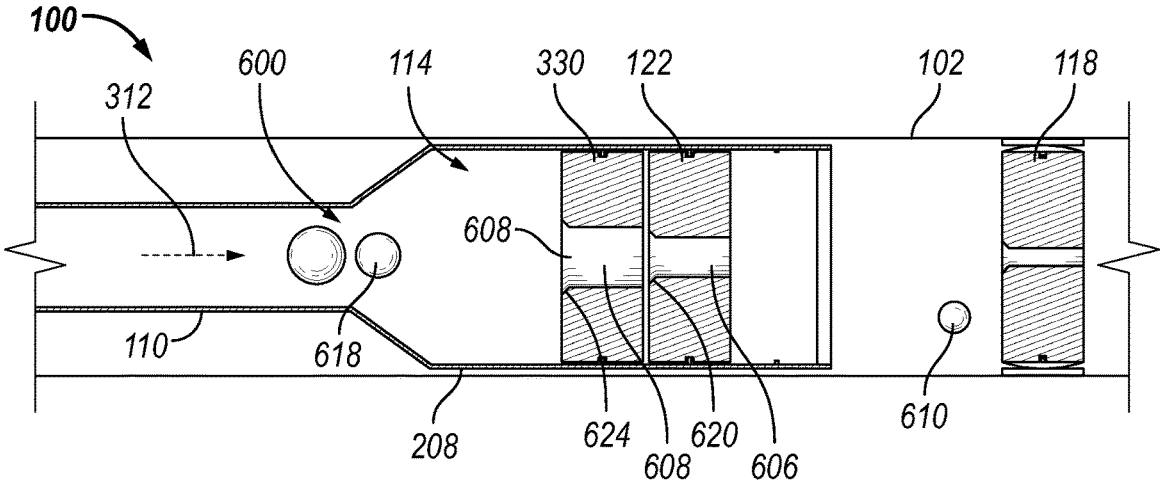

FIG. 6A-6C illustrate a cross-sectional view of a downhole tool deployment apparatus 100 comprising an actuation mechanism 114 having a plurality of variably sized balls 600 configured to engage landing shoulders 612 of respective downhole tools 104, in accordance with some embodiments of the present disclosure. In particular, FIG. 6A discloses the plurality of downhole tools 104 housed within the tool chamber 108 of the outer housing 208 of the downhole tool deployment apparatus 100. As illustrated, each downhole tool 104 of the plurality of downhole tools 104 (e.g., a first downhole tool 118, a second downhole tool 122, and a third downhole tool 330) includes a corresponding flow channel 602 (e.g., a first flow channel 604, a second flow channel 606, and a third flow channel 608) having a unique diameter. The fluid flow 312 may flow through the flow channels 602 to maintain fluid circulation while running the downhole tools 104 into the wellbore 102 (e.g., pump-through capability.)

The downhole tools 104 may be arranged within the tool chamber 108 based at least in part on the respective diameters of the corresponding flow channels 602. In the illustrated embodiment, each of the plurality of downhole tools 104 are secured within the housing apparatus 106 in an ascending order of the respective diameters. That is, the first downhole tool 118 with the smallest diameter is secured proximate the lower opening 206 in the lower axial end 204 of the housing apparatus 106, the second downhole tool 122 with the second smallest diameter is secured axially upward the first downhole tool 118 with respect to the outer housing 208, and the third downhole tool 330 having the largest diameter is secured axially upward the second downhole tool 122 with respect to the outer housing 208. However, the plurality of downhole tools 104 may be secured within the tool chamber 108 in any suitable arrangement.

Moreover, the plurality of downhole tools 104 may be secured to the inner surface 308 of the outer housing 208 via respective retention devices 306 (e.g., shear pins, etc.) such that the plurality of downhole tools 104 may be retained within the tool chamber 108 as the downhole tool deployments apparatus travels along the wellbore 102 to the respective locations for ejecting each of the plurality of downhole tools 104. The actuation mechanism 114 may be configured to selectively eject each of the plurality of downhole tools 104 by providing sufficient force on a respective downhole tool to overcome (e.g., break, deflect, etc.) the corresponding retention device 306 securing the respective downhole tool.

FIG. 6B discloses a first ball 610 of the plurality of variably sized balls 600 landed on the first downhole tool 118 of the plurality of downhole tools 104. The actuation mechanism 114 comprises the plurality of variably sized balls 600. In some embodiments, the variably sized balls 600 are configured travel with the fluid flow 312 in the conveyance 110 from the surface (shown in FIG. 1) to the outer housing 208. To selectively eject each of the plurality of downhole tools 104, each of the variably sized balls 600 may be selectively introduced into the fluid flow 312 at or proximate the surface. In some embodiments, the variably sized balls 600 may be housed within the conveyance 110, outer housing 208, or other suitable downhole component, and may be selectively introduced via a dispenser configured to output each of the balls either automatically or in response to manual input.

Each ball of the plurality of variably sized balls 600 may have a unique diameter configured to eject a respective downhole tool by blocking fluid flow 312 through the corresponding flow channel 602 of the respective downhole tool 104. For example, a first ball 610 may include a first ball 610 diameter that is larger than a first channel diameter of the first flow channel 604 of the first downhole tool 118, but smaller than the respective channel diameters (e.g., second channel diameter and third channel diameter) of the second flow channel 606 and third flow channel 608, respectively, such that the first ball 610 may pass through the second downhole tool 122 and third downhole tool 330 to land on the first downhole tool 118.

Each of the downhole tools 104 may include a respective landing shoulder 612 configured receive the corresponding variably sized ball 600. For example, the first downhole tool 118 may include a first landing shoulder 614 configured to receive the first ball 610. The landing shoulder 612 may include a tapered shape that extends from the respective flow channel 602 to an upper surface 616 of the respective downhole tool 104. The diameter of the landing shoulder 612 may increase in the direction from the flow channel 602 toward the upper surface 616 of the respective downhole tool 104. Based at least in part on the shape of the landing shoulder 612, the landing shoulder 612 may be configured to center the respective variably sized ball 600 over the corresponding flow channel 602 such that the fluid flow 312 through the flow channel 602 is blocked by the respective variably sized ball 600. Blocking the fluid flow 312 through the flow channel 602 may increase fluid pressure within the outer housing 208. The pressure in the outer housing 208 may exert a downward force (e.g., a force in the axially downward direction 328 toward the lower opening 206) on the downhole tool 104. In response to the pressure exceeding a threshold pressure for the respective retention device 306, the force on the downhole tool 104 may cause the retention device 306 to break or deflect; thereby, permitting movement of the respective downhole tool 104. Continued pressure on the respective downhole tool 104 may cause the respective downhole tool 104 to slide axially out of the housing apparatus 106 at a desired location in the wellbore 102.

FIG. 6C discloses the first downhole tool 118 ejected from the outer housing 208 of the downhole tool deployment apparatus 100 at a respective location in the wellbore 102. With the first downhole tool 118 ejected, the fluid flow 312 through the conveyance 110 may flow through the second flow channel 606 and the third flow channel 608 of the second downhole tool 122 and the third downhole tool 330, respectively, such that the pressure in the outer housing 208 may decrease to level below the threshold pressure. In response to ejecting the first downhole tool 118, the downhole tool deployment apparatus 100 may be configured to relocate the outer housing 208 to an installation location for the second downhole tool 122. To eject the second downhole tool 122 at the respective location, a second ball 618 of the plurality of variably sized balls 600 may be introduced into the fluid flow 312 such that the second ball 618 passes through the third flow channel 608 and lands on a second landing shoulder 620 of the second downhole tool 122; thereby, blocking the fluid flow 312 through the second flow channel 606. Blocking the fluid flow 312 through the second flow channel 606 may sufficiently increase the pressure in the outer housing 208 to break or deflect the retention device 306 securing the second downhole tool 122 and eject the second downhole tool 122. The third downhole tool 330 may be similarly ejected at a respective location along the wellbore 102 by landing a third ball 622 of the plurality of variably sized balls 600 on a third landing shoulder 624 of the third downhole tool 330.

Accordingly, the present disclosure may provide systems and methods for selectively ejecting each downhole tool of a plurality of downhole tools at respective locations along a wellbore. The systems and methods may include any of the various features disclosed herein, including one or more of the following statements.

Statement 1. A system for deploying downhole components may comprise a housing apparatus comprising a tool chamber configured to house a plurality of downhole tools; a conveyance configured to run the housing apparatus along a wellbore, wherein the housing apparatus is secured to an end of the conveyance; and an actuation mechanism configured to selectively eject individual downhole tools of the plurality of downhole tools from the housing apparatus at respective locations in the wellbore.

Statement 2. The system of statement 1, wherein the actuation mechanism comprises a continuous screw mechanism having a rotating helical screw blade, wherein the rotating helical screw blade is positioned within the housing apparatus.

Statement 3. The system of statement 1 or statement 2, wherein the actuation mechanism comprises an electric motor configured to drive rotation of the rotating helical screw blade.

Statement 4. The system of any preceding statement, wherein the actuation mechanism is electrically coupled to a control system disposed at a surface of the wellbore via a wired connection, and wherein the actuation mechanism is configured to actuate the rotating helical screw blade in response to electrical signals from the control system.

Statement 5. The system of any preceding statement, further comprising a retention device positioned proximate an opening in a lower axial end of the housing apparatus, wherein the retention device is configured to at least partially restrain at least one downhole tool of the plurality of downhole tools from sliding axially toward the opening in the lower axial end.

Statement 6. The system of statement 1 or statement 5, wherein the actuation mechanism comprises an inner housing disposed within an outer housing of the housing apparatus, wherein the inner housing is configured to slide axially with respect to the outer housing, and wherein a first axial end of the inner housing is configured to push at least one downhole tool of the plurality of downhole tools toward an opening in a lower axial end of the outer housing.

Statement 7. The system of any one of statements 1, 5, and 6, wherein the inner housing is configured to slide axially toward the opening in a lower axial end of the outer housing in response to pressure from a fluid flow through the conveyance.

Statement 8. The system of any one of statements 1 and 5-7, wherein the outer housing comprises a plurality of fluid exhaust ports, wherein at least a first exhaust port and a second exhaust port are axially offset along the outer housing, wherein the first exhaust port is configured to exhaust fluid flow in a first position of the inner housing with respect to the outer housing, and wherein the first exhaust port and the second exhaust port are configured to exhaust fluid flow in a second position of the inner housing with respect to the outer housing.

Statement 9. The system of any one of statements 1 and 5-8, wherein the actuation mechanism comprises a spiraled J-slot mechanism, wherein the spiraled J-slot mechanism is configured to control movement of the inner housing with respect to the outer housing to selectively eject the individual downhole tools.

Statement 10. The system of any one of statements 1 and 5-9, wherein the spiraled J-slot mechanism is configured to incrementally slide the inner housing axially toward the opening in a lower axial end of the outer housing in response to intermittent fluid flow through the conveyance.

Statement 11. The system of any one statements 1 and 5-10, further comprising the plurality of downhole tools secured in the tool chamber within the housing apparatus, wherein each downhole tool of the plurality of downhole tools comprises a respective flow channel having a unique diameter, wherein the plurality of downhole tools are secured within the housing apparatus in an ascending order of the respective diameters, and wherein a first downhole tool with a smallest diameter is secured proximate an opening in a lower axial end of the housing apparatus and a last downhole tool having the smallest diameter is secured axially uphole in the housing apparatus with respect to the first downhole tool.

Statement 12. The system of any one of statements 1, 5, and 11, wherein the actuation mechanism comprises a plurality of balls, wherein each ball of the plurality of balls comprises a unique diameter corresponding to the unique diameter of a respective downhole tool, and wherein each ball of the plurality of balls is configured to be selectively released into the housing apparatus and received by the respective downhole tool to block fluid flow through the housing apparatus and increase pressure in the housing apparatus, wherein the increased pressure is configured to cause the respective downhole tool to slide axially out of the housing apparatus at the respective location in the wellbore.

Statement 13. The system of any proceeding statement, wherein the conveyance comprises coiled tubing, segmented drill piping, or some combination thereof.

Statement 14. A system for deploying downhole components may comprise a housing apparatus comprising an outer housing, a tool chamber disposed within the outer housing and configured to house a plurality of downhole tools, an upper axial end configured to couple to a conveyance for running the housing apparatus along a wellbore, a lower axial end disposed opposite the upper axial end and having an opening extending from an exterior of the lower axial end to the tool chamber, and a central passageway extending from an opposite end of the tool chamber to an opening in the upper axial end; and an actuation mechanism secured within the housing apparatus and configured to selectively eject individual downhole tools of the plurality of downhole tools from the housing apparatus at respective locations in the wellbore in response to fluid and/or electronic communication received via the conveyance.

Statement 15. The system of statement 14, wherein the actuation mechanism comprises a continuous screw mechanism having a helical screw blade positioned at least partially within the tool chamber, wherein an electric motor is configured to rotate the helical screw blade in response to electronic communication.

Statement 16. The system of statement 14, wherein the actuation mechanism comprises an inner housing disposed within the outer housing, wherein the inner housing is configured to slide axially with respect to the outer housing in response to fluid communication received via the conveyance, and wherein a first axial end of the inner housing is configured to push at least one downhole tool of the plurality of downhole tools toward the opening in the lower axial end.

Statement 17. A method of deploying downhole components may comprise loading a plurality of downhole tools into a housing apparatus secured to an end of a conveyance; running the housing apparatus into a wellbore to a first location; actuating an actuation mechanism to selectively eject a first downhole tool of the plurality of downhole tools; moving the housing apparatus to a second location in the wellbore; and actuating the actuation mechanism to selectively eject a second downhole tool of the plurality of downhole tools.

Statement 18. The method of statement 17, wherein the actuation mechanism comprises a continuous screw mechanism having a helical screw blade, wherein the helical screw blade is positioned within the housing apparatus, and wherein loading the plurality of downhole tools into the housing apparatus comprises rotating the helical screw blade in reverse and depositing each of the plurality of downhole tools in separate gaps defined by the helical screw blade along a central axis of the helical screw blade.

Statement 19. The method of statement 17, wherein the actuation mechanism comprises an inner housing disposed within an outer housing of the housing apparatus, wherein actuating the actuation mechanism to selectively eject a first downhole tool comprises driving the inner housing, via pressure from a fluid flow through the housing apparatus, into the second downhole tool to move the first and second downhole tools axially and eject the first downhole tool, and wherein actuating the actuation mechanism to selectively eject a second downhole tool comprises further driving the inner housing into the second downhole tool to move the second downhole tools axially and eject the second downhole tool.

Statement 20. The method of statement 17, wherein the actuation mechanism comprises a plurality of balls having unique diameters, wherein actuating an actuation mechanism to selectively eject a first downhole tool comprises plugging a first fluid passage through the first downhole tool with a first ball of the plurality of balls, and wherein actuating the actuation mechanism to selectively eject a second downhole tool comprises plugging a second fluid passage through the second downhole tool with a second ball of the plurality of balls.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. A system for deploying downhole components, comprising:

a housing apparatus comprising a tool chamber configured to house a plurality of downhole tools;

a conveyance configured to run the housing apparatus along a wellbore, wherein the housing apparatus is secured to an end of the conveyance; and an actuation mechanism configured to selectively eject individual downhole tools of the plurality of downhole tools from the housing apparatus at respective locations in the wellbore, wherein the actuation mechanism comprises a plurality of balls, wherein each ball of the plurality of balls comprises a unique diameter corresponding to the unique diameter of a respective downhole tool, and wherein each ball of the plurality of balls is configured to be selectively released into the housing apparatus and received by the respective downhole tool to block fluid flow through the housing apparatus and increase pressure in the housing apparatus, wherein the increased pressure is configured to cause the respective downhole tool to slide axially out of the housing apparatus at the respective location in the wellbore, and wherein fluid is configured to circulate through the actuation mechanism and the housing apparatus after ejecting all of the plurality of downhole tools from the housing apparatus.

2. The system of claim 1, further comprising a retention device positioned proximate an opening in a lower axial end of the housing apparatus, wherein the retention device is configured to at least partially restrain at least one downhole tool of the plurality of downhole tools from sliding axially toward the opening in the lower axial end.

3. The system of claim 1, further comprising the plurality of downhole tools secured in the tool chamber within the housing apparatus, wherein each downhole tool of the plurality of downhole tools comprises a respective flow channel having a unique diameter, wherein the plurality of downhole tools are secured within the housing apparatus in an ascending order of the respective diameters of flow channels, and wherein a first downhole tool with a smallest diameter flow channel is secured proximate an opening in a lower axial end of the housing apparatus and a last downhole tool having the largest diameter flow channel is secured axially uphole in the housing apparatus with respect to the first downhole tool.

4. The system of claim 1, wherein the conveyance comprises coiled tubing, segmented drill piping, or some combination thereof.

5. A system for deploying downhole components, comprising:

a housing apparatus comprising a tool chamber configured to house a plurality of downhole tools;

a conveyance configured to run the housing apparatus along a wellbore, wherein the housing apparatus is secured to an end of the conveyance; and an actuation mechanism configured to selectively eject individual downhole tools of the plurality of downhole tools from the housing apparatus at respective locations in the wellbore, wherein the actuation mechanism comprises a continuous screw mechanism having a rotating helical screw blade, wherein the rotating helical screw blade is positioned within the housing apparatus, and wherein fluid is configured to circulate through the actuation mechanism and the housing apparatus after ejecting all of the plurality of downhole tools from the housing apparatus.

6. The system of claim 5, wherein the actuation mechanism comprises an electric motor configured to drive rotation of the rotating helical screw blade.

7. The system of claim 5, wherein the actuation mechanism is electrically coupled to a control system disposed at a surface of the wellbore via a wired connection, and wherein the actuation mechanism is configured to actuate the rotating helical screw blade in response to electrical signals from the control system.

8. A system for deploying downhole components, comprising:

a housing apparatus comprising a tool chamber configured to house a plurality of downhole tools;

a conveyance configured to run the housing apparatus along a wellbore, wherein the housing apparatus is secured to an end of the conveyance; and an actuation mechanism configured to selectively eject individual downhole tools of the plurality of downhole tools from the housing apparatus at respective locations in the wellbore,, wherein the actuation mechanism comprises an inner housing disposed within an outer housing of the housing apparatus, wherein the inner housing is configured to slide axially with respect to the outer housing, and wherein a first axial end of the inner housing is configured to push at least one downhole tool of the plurality of downhole tools toward an opening in a lower axial end of the outer housing, and wherein fluid is configured to circulate through the actuation mechanism and the housing apparatus after ejecting all of the plurality of downhole tools from the housing apparatus.

9. The system of claim 8, wherein the inner housing is configured to slide axially toward the opening in a lower axial end of the outer housing in response to pressure from a fluid flow through the conveyance.

10. The system of claim 8, wherein the outer housing comprises a plurality of fluid exhaust ports, wherein at least a first exhaust port and a second exhaust port are axially offset along the outer housing, wherein the first exhaust port is configured to exhaust fluid flow in a first position of the inner housing with respect to the outer housing, and wherein the first exhaust port and the second exhaust port are configured to exhaust fluid flow in a second position of the inner housing with respect to the outer housing.

11. The system of claim 8, wherein the actuation mechanism comprises a spiraled J-slot mechanism, wherein the spiraled J-slot mechanism is configured to control movement of the inner housing with respect to the outer housing to selectively eject the individual downhole tools.

12. The system of claim 11, wherein the spiraled J-slot mechanism is configured to incrementally slide the inner housing axially toward the opening in a lower axial end of the outer housing in response to intermittent fluid flow through the conveyance.

13. A system for deploying downhole components, comprising:

a housing apparatus, wherein the housing apparatus comprises:

an outer housing;

a tool chamber disposed within the outer housing and configured to house a plurality of downhole tools;

an upper axial end configured to couple to a conveyance for running the housing apparatus along a wellbore;

a fluid chamber formed within the outer housing proximate the upper axial end;

a plurality of exhaust ports extending through the outer housing from the fluid chamber to a wellbore, wherein the exhaust ports are axially offset from each other along the outer housing;

a lower axial end disposed opposite the upper axial end and having an opening extending from an exterior of the lower axial end to the tool chamber; and a central passageway extending from an opposite end of the tool chamber to an opening in the upper axial end; and an actuation mechanism secured within the housing apparatus and configured to selectively eject individual downhole tools of the plurality of downhole tools from the housing apparatus at respective locations in the wellbore in response to fluid communication received via the conveyance, wherein the actuation mechanism comprises an inner housing configured to eject the downhole tools via sliding axially along the outer housing to push the plurality of downhole tools out of the housing apparatus in response to pressure in the fluid chamber exceeding a threshold pressure, and wherein each exhaust port of the plurality of exhaust ports is positioned to generate a respective pressure drop after ejection of a corresponding downhole tool to stop movement of the inner housing such that each downhole tool is selectively ejected.

14. The system of claim 13, wherein a first axial end of the inner housing is configured to push at least one downhole tool of the plurality of downhole tools toward the opening in the lower axial end.

15. The system of claim 13, wherein the inner housing comprises a rupture disc configured to block fluid flow through the inner housing from the fluid chamber to the tool chamber, and wherein where the rupture disc is configured to break to allow fluid to circulate through the actuation mechanism and the housing apparatus after all of the plurality of downhole tools are ejected from the housing apparatus.

16. A method of deploying downhole components, comprising:

loading a plurality of downhole tools into a housing apparatus secured to an end of a conveyance;

running the housing apparatus into a wellbore to a first location;

actuating an actuation mechanism to selectively eject a first downhole tool of the plurality of downhole tools, wherein the actuation mechanism comprises a continuous screw mechanism having a helical screw blade, wherein the helical screw blade is positioned within the housing apparatus, and wherein loading the plurality of downhole tools into the housing apparatus comprises rotating the helical screw blade in reverse and depositing each of the plurality of downhole tools in separate gaps defined by the helical screw blade along a central axis of the helical screw blade;

moving the housing apparatus to a second location in the wellbore;

actuating the actuation mechanism to selectively eject a second downhole tool of the plurality of downhole tools; and circulating fluid through the actuation mechanism and the housing apparatus after ejecting all of the plurality of downhole tools from the housing apparatus.

17. A method of deploying downhole components, comprising:

loading a plurality of downhole tools into a housing apparatus secured to an end of a conveyance;

running the housing apparatus into a wellbore to a first location;

actuating an actuation mechanism to selectively eject a first downhole tool of the plurality of downhole tools, wherein the actuation mechanism comprises an inner housing disposed within an outer housing of the housing apparatus, wherein actuating the actuation mechanism to selectively eject the first downhole tool comprises driving the inner housing, via pressure from a fluid flow through the housing apparatus, into the second downhole tool to move the first and second downhole tools axially and eject the first downhole tool;

moving the housing apparatus to a second location in the wellbore;

actuating the actuation mechanism to selectively eject a second downhole tool of the plurality of downhole tools, and wherein actuating the actuation mechanism to selectively eject the second downhole tool comprises further driving the inner housing into the second downhole tool to move the second downhole tools axially and eject the second downhole tool; and circulating fluid through the actuation mechanism and the housing apparatus after ejecting all of the plurality of downhole tools from the housing apparatus.

18. A method of deploying downhole components, comprising:

loading a plurality of downhole tools into a housing apparatus secured to an end of a conveyance;

running the housing apparatus into a wellbore to a first location;

actuating an actuation mechanism to selectively eject a first downhole tool of the plurality of downhole tools, wherein the actuation mechanism comprises a plurality of balls having unique diameters, wherein actuating an actuation mechanism to selectively eject the first downhole tool comprises plugging a first fluid passage through the first downhole tool with a first ball of the plurality of balls;

moving the housing apparatus to a second location in the wellbore;

actuating the actuation mechanism to selectively eject a second downhole tool of the plurality of downhole tools, and wherein actuating the actuation mechanism to selectively eject the second downhole tool comprises plugging a second fluid passage through the second downhole tool with a second ball of the plurality of balls; and circulating fluid through the actuation mechanism and the housing apparatus after ejecting all of the plurality of downhole tools from the housing apparatus.

* * * * *